US005343282A

United States Patent [19]

Kazaki et al.

[11] Patent Number: 5,343,282

[45] Date of Patent: Aug. 30, 1994

[54] COLOR BALANCE ADJUSTING APPARATUS FOR FULL-COLOR COPIER

[75] Inventors: Yuichi Kazaki, Yamatokoriyama; Yasutaka Maeda, Ikoma; Hiroshi Kawamoto, Nara; Hideyuki Nishimura; Katsuhiro Nagayama, both of Yamatokoriyama, all of Japan

[73] Assignee: Sharp Kabushiki Kaisha, Osaka, Japan

[21] Appl. No.: 99,739

[22] Filed: Jul. 30, 1993

[30] Foreign Application Priority Data

Aug. 6, 1992 [JP] Japan ..... 4-209844

[51] Int. Cl.[5] ..... G03G 21/00

[52] U.S. Cl. ..... 355/326 R; 355/208; 355/246; 355/327; 358/461

[58] Field of Search ..... 355/203, 204, 208, 245, 355/246, 327, 326 R, 228, 229; 358/406, 461

[56] References Cited

U.S. PATENT DOCUMENTS

| | | | |
|---|---|---|---|
| 4,277,162 | 7/1981 | Kasahara et al. | 355/208 |
| 4,989,043 | 1/1991 | Suzuki et al. | 355/246 |
| 5,005,049 | 4/1991 | Matsushita | 355/208 |
| 5,206,686 | 4/1993 | Fukui et al. | 355/208 |
| 5,210,572 | 5/1993 | MacDonald et al. | 355/208 |

FOREIGN PATENT DOCUMENTS

| | | |
|---|---|---|
| 60-98462 | 6/1985 | Japan . |
| 63-14268 | 6/1988 | Japan . |

*Primary Examiner*—A. T. Grimley
*Assistant Examiner*—Sandra L. Brasé
*Attorney, Agent, or Firm*—David G. Conlin; George W. Neuner

[57] ABSTRACT

A color balance adjusting apparatus is used for a full color copier in which an original image is illuminated by a light source; the illuminated image is exposed onto a photoreceptor to form electrostatic latent images corresponding to first, second and third colors for creating a color image; and each of the formed electrostatic latent images is developed into a visualized toner image. The color balance adjusting apparatus includes an infrared sensor for detecting toner density of the toner image formed with a toner having any one color of the first, second and third colors. The apparatus further includes automatic adjustment means which determines a relation of light intensity to toner density detected for one color by varying light intensity of said light source, and which determines optimal light intensity for the other two colors as predetermined functions of obtained optimal light intensity. Using this apparatus, automatic adjustment of the color balance for each copy mode can be effected in a short time with lesser consumption of electricity and supplies.

4 Claims, 4 Drawing Sheets

COLOR BALANCE ADJUSTING APPARATUS FOR FULL-COLOR COPIER

BACKGROUND OF THE INVENTION

1. Filed of the invention

The present invention relates to a color balance adjusting apparatus for use in full-color copiers, and particularly to the color balance adjusting apparatus for use in full-color copiers that operates in link with an automatic control function of image density.

2. Description of the Related Art

In the field of full color copiers, the adjustment of color balance of a color image used to be carried out by using an original having various gradations of gray patches. With such an original, a service engineer would adjust the apparatus such that the gray patches of the original might be reproduced as certain gray colors. In this case, the copying operations used to be repeated while the service engineer adjusting the color balance, or adjusting each toner amount of color components, i.e., yellow, magenta and cyan until the reproduced color of certain patches would be gray.

This series of operations had to be performed for different copy modes.

In the conventional method described above, since the balancing condition of yellow, magenta and cyan is so delicate and unstable that if one component of the colors deviates from the balanced condition to a slight degree, the composed color might be totally off balance. As a result, the service engineers cannot perform a speedy adjustment. Therefore, in the adjustment using the conventional method, the service engineer must practice a lot of testing copies for the adjustment of a machine having multiple modes, so that the number of copies would be increased, and therefore the developer and the photoreceptor would be exhausted or worn out resulting in cost increase. Still, in view of the user side, the adjustment must take a prolonged period of time, so this would cause an unfavorable impression upon users.

As an apparatus for adjusting the color balance automatically, there has been proposed means in which the voltage of lamp is automatically changed to record each toner image of yellow, magenta and cyan on a photoreceptor and the thus created toner images are measured on the density with an infrared sensor. In this case, each colors of yellow, Magenta and cyan must be recorded, therefore the adjustment time, the consumption of power and the use amount of supplies are increased. Besides, in case a user activates the color balance adjustment mode erroneously, the copier remains engaged in operation over a prolonged period of time without discharging any recorded sheet, thus giving the user a feeling of uneasiness.

SUMMARY OF THE INVENTION

It is therefore an object of the present invention to provide a color balance adjusting apparatus for use in full color copiers, capable of automatically adjusting the color balance for each copy mode in a short period of time with the least consumption of energy of power and supplies.

The above object of the present invention can be achieved by a first construction, and the characteristic feature of the first construction lies in that a color balance adjusting apparatus is used for a full color copier in which an original image is illuminated by a light source; the illuminated image is exposed onto a photoreceptor to form electrostatic latent images corresponding to first, second and third colors for creating a color image; and each of the formed electrostatic latent images is developed into a visualized toner image, and the color balance adjusting apparatus comprises:

an infrared sensor for detecting toner density of the toner image formed with a toner having any one color of the first, second and third colors; and automatic adjustment means, determining a relation of light intensity to toner density detected for one color by varying light intensity of the light source, and determining optimal light intensity for the other two colors as predetermined functions of obtained optimal light intensity.

In accordance with a second aspect of the present invention, a color balance adjusting apparatus is used for a full color copier in which an original image is illuminated by a light source; the illuminated image is exposed onto a photoreceptor to form electrostatic latent images corresponding to first, second and third colors for creating a color image; and each of the formed electrostatic latent images is developed into a visualized toner image, and the color balance adjusting apparatus comprises:

an infrared sensor for detecting toner density of the toner image formed with a toner having any one color of the first, second and third colors; and automatic adjustment means, determining a relation of light intensity to toner density detected for one color by varying light intensity of the light source, and determining optimal light intensity for the other two colors as predetermined functions of obtained optimal light intensity, and the apparatus is constructed such that the automatic adjustment means operates in link with an image density automatically controlling function and effects the automatic adjustment after an image density correction.

In accordance with a third aspect of the present invention, a color balance adjusting apparatus is used for a full color copier in which an original image is illuminated by a light source; the illuminated image is exposed onto a photoreceptor to form electrostatic latent images corresponding to first, second and third colors for creating a color image; and each of the formed electrostatic latent images is developed into a visualized toner image, the color balance adjusting apparatus comprises:

an infrared sensor for detecting toner density of the toner image formed with a toner having any one color of the first, second and third colors; and automatic adjustment means, determining a relation of light intensity to toner density detected for one color by varying light intensity of the light source, and determining optimal light intensity for the other two colors as predetermined functions of obtained optimal light intensity, and the apparatus is constructed such that the means uses the obtained optimal light intensity for three-colors and determines optimal light intensity for each of other copy modes belonging to the same copy process by using predetermined functions.

In accordance with a fourth aspect of the present invention, a color balance adjusting apparatus is used for a full color copier in which an original image is illuminated by a light source; the illuminated image is exposed onto a photoreceptor to form electrostatic latent images corresponding to first, second and third colors for creating a color image; and each of the formed electrostatic latent images is developed into a visualized toner image, the color balance adjusting apparatus comprises:

an infrared sensor for detecting toner density of the toner image formed with a toner having any one color of the first, second and third colors; and automatic adjustment means, determining a relation of light intensity to toner density detected for one color by varying light intensity of the light source, and determining optimal light intensity for the other two colors as predetermined functions of obtained optimal light intensity, and the apparatus is constructed such that the means uses the obtained optimal light intensity for three-colors and determines optimal light intensity for each of other copy modes belonging to the same copy process by using predetermined functions; and the automatic adjustment means operates in link with an image density automatically controlling function and effects the automatic adjustment after an image density correction.

As the present invention is thus constructed, if optimal light intensity for a first color could be determined, it is possible to determine optimal light intensity for second and third colors as functions of the condition for the first color, because there are known relations among the three. Further, if any two copy modes belong to the same process, there exists a certain predetermined relation between two modes, so that the condition for one copy mode can be determined as functions of the condition for the other.

Accordingly, by determining an optimal light intensity for one color, it is possible to determine optimal light intensity for the other two colors as functions of the former color by mere, extremely simple calculations. Further, it is also possible to determine optimal light intensity for each color under the same process by mere, extremely simple calculations. As a result, automatic adjustment of the color balance can be effected in a short time with lesser consumption of electricity and supplies. Since the apparatus is constructed in link with the image density automatically controlling function, the automatic adjustment of color balance may be effected even after the image density correction.

DESCRIPTION OF THE PREFERRED EMBODIMENTS

An embodiment of the present invention will hereinafter be described with reference to the accompanying drawings.

Figure 2:
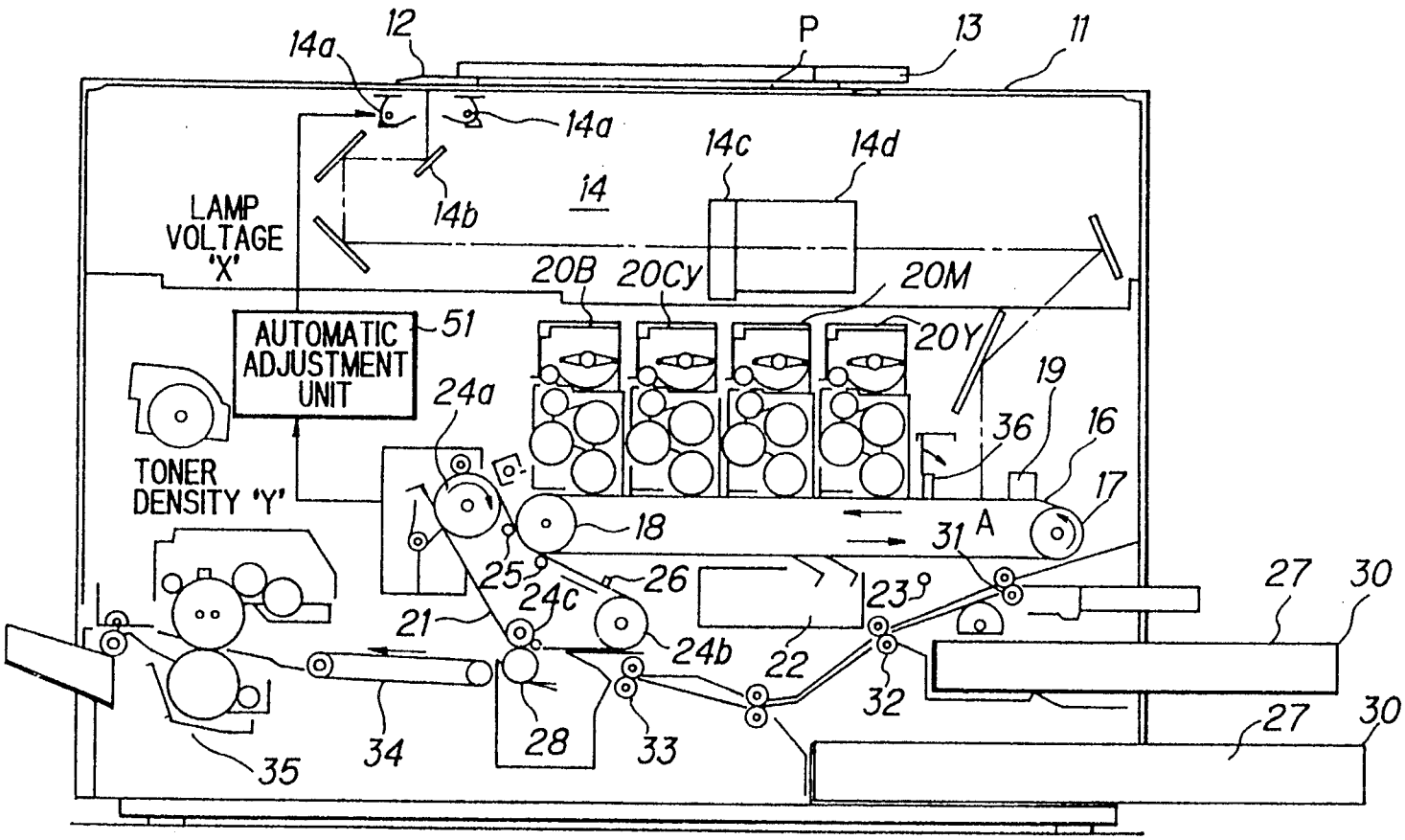
FIG. 2 is a schematic structural view showing a color copier equipped with a color balance adjusting apparatus shown in FIG. 1.

First of all, referring to FIG. 2, description will be made on a structure of a color copier equipped with a color balance adjusting apparatus of the embodiment. In FIG. 2, a transparent original setting table 11 for placing an original P is fixed on the top of the machine frame with an opaque metal plate 12. An opaque original pressing plate 13 for pressing an original P on original setting table 11 is provided capable of being opened and closed. Printed on the upper face of metal plate 12 are, for example, original sizes and the like. At least one of metal plate 12 and original pressing plate 13 has a white under surface by means of, for example, a white printing.

Arranged under original setting table 11 is an exposure optical system 14 for scanning an image of original P. The exposure optical system 14 can move in an auxiliary scan direction from a home position which lies underneath metal plate 12. Exposure optical system 14 includes exposure lamps **14*a* for illuminating the under surface of original P through transparent original setting table 11, a plurality of mirrors 14*b* for leading the reflected light from original P along a path shown by a dashed line in FIG. 2 to an exposure position A on a photoreceptor 16, a color separating filter assembly 14*c* having filters of three primary colors, i.e., red, green and blue, and an image-forming lens 14*d***.

Photoreceptor 16, composed of a belt member and wound around a driven roller 17 and a driving roller 18, can be moved by the rollers in a counterclockwise direction in the figure. A charger 19 is disposed upstream of exposure position A. In this embodiment, a typical color combination of first, second and third colors for composing a color image uses yellow, magenta and cyan. Accordingly, a yellow developer 20Y, a magenta developer 20M and a cyan developer 20Cy are arranged in that order downstream of exposure position A. A black developer 20B for practicing black and white copy or used for four-color copy is disposed downstream of the above three developers. Further, there are provided around the photoreceptor, an intermediate transfer medium 21 for intermediately supporting toner images of photoreceptor 16 thereon, a cleaning unit 22 and an erasing lamp 23. Here, reference numeral 36 designates a screen used in a photo-process mode, which will be described later.

Figure 3:
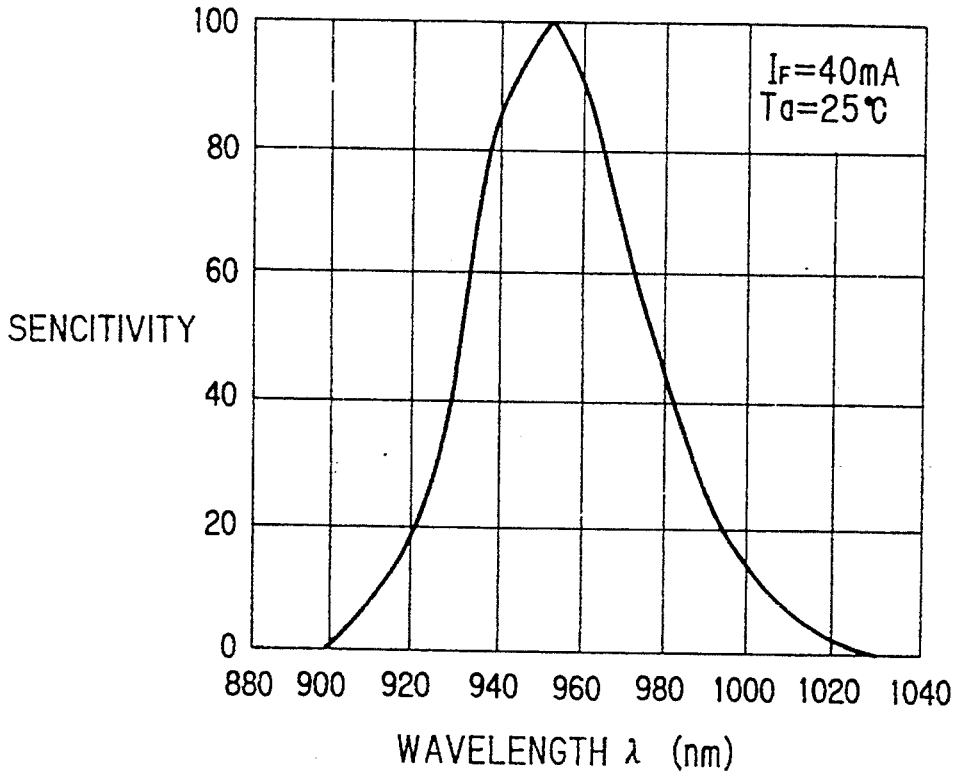
FIG. 3 is a graphic chart showing a characteristic of an infrared sensor shown in FIGS. 1 and 2.

Intermediate transfer medium 21 is made of a black film of a polycarbonate resin into which carbon particles are dispersed, and is composed, like photoreceptor 16, of a belt member wound around first to third rollers **24*a* to 24*c* be movable in a clockwise direction in the figure. Further, there are provided transfer rollers 25 to bring the medium 21 into pressing contact with photoreceptor 16. An infrared sensor 26 used for the color balance adjustment is arranged downstream of transfer rollers 25. Third roller 24*c* is pressingly abutted via the medium 21 against a transfer roller 28 for transferring a toner image on intermediate transfer medium 21 to a copy sheet 27. Infrared sensor 26 uses a device that exclusively senses light having wavelengths of, particularly, 750 nm or more. A typical characteristic curve of such an infrared sensor 26** is shown in FIG. 3.

Copy sheets 27 are set previously in cassettes 30 disposed at right lower positions. A copy sheet 27 thus arranged is conveyed by means of feed rollers 31 and 32 to a position of timing rollers 33. The timing rollers 33 deliver the sheet toward the position of transfer roller 28 at such a timing that the sheet may meet with or be registered with the toner image at the position of transfer roller 28. The copy sheet 27 with the toner image transferred thereon is conveyed by a conveyor belt 34 to a fixer 35, with which the toner image is fixed to be discharged out. To sum up, an image on an original P is duplicated on a copy paper 27 by the processing steps of charging, exposing, developing and transferring.

One example of an automatic adjusting means is embodied by an automatic adjustment unit 51, which is input with toner density 'y' detected by an infrared sensor to be referred to hereinafter. With this toner density 'y', automatic adjustment unit 51 can determine a lamp voltage 'x' for exposure lamps 14a to automatically adjust the color balance of yellow, magenta and cyan.

In the configurations described heretofore, when a normal color copying operation is performed, an image of original P is scanned three times, thereby to be decomposed into three separate colored images by color separating filters 14c, and electrostatic latent images of three-colors are formed on photoreceptor 16. Each electrostatic latent image on photoreceptor 16 is separately developed into a visual image by each toner of yellow developer 20Y, magenta developer 20M and cyan developer 20Cy which are complementary colors of respective colors of color separating filters 14c. The thus visualized toner images are transferred onto intermediate transfer medium 21. In a normal color duplication process, black developer 20B, infrared sensor 26 are unemployed. On the other hand, the black and white duplication process employs black developer 20B only.

Next, referring to FIG. 1, description will be made on a detailed structure of color balance adjusting apparatus 50 of the embodiment. The color balance adjusting apparatus 50 includes an automatic adjustment unit 51 for adjusting an exposure voltage of exposure lamps 14a, a surface potential modifying unit 55 controlling applied voltage to charger 19 to modify the electrified voltage on the surface of photoreceptor 16 when the developers are degraded as the copy volume increases, or the transfer efficiency or the surface potential is reduced due to variation of the surroundings.

Automatic adjustment unit 51 includes a comparing circuit 52 for comparing a toner density 'y' detected by infrared sensor 26 upon a color balance adjustment with a reference value $A_0$, a memory 53 for storing optimal voltage values $x_y$, $x_m$ and $x_c$ set up upon the adjustment of color balance for respective yellow, magenta and cyan lamps, and an exposure voltage control circuit 54 for applying to exposure lamps 14a with exposure voltages corresponding to respective optimal exposure voltage values $x_y$, $x_m$ and $x_c$ stored in memory 53 when a normal three-color duplication process is carried out. In this connection, in a case where color balance is adjusted by controlling a driver voltage of charger 19, the value of a surface potential of photoreceptor 16 will be changed into a surface potential $V_0$ that is set up externally higher than a surface potential at a normal image forming.

Figure 1:
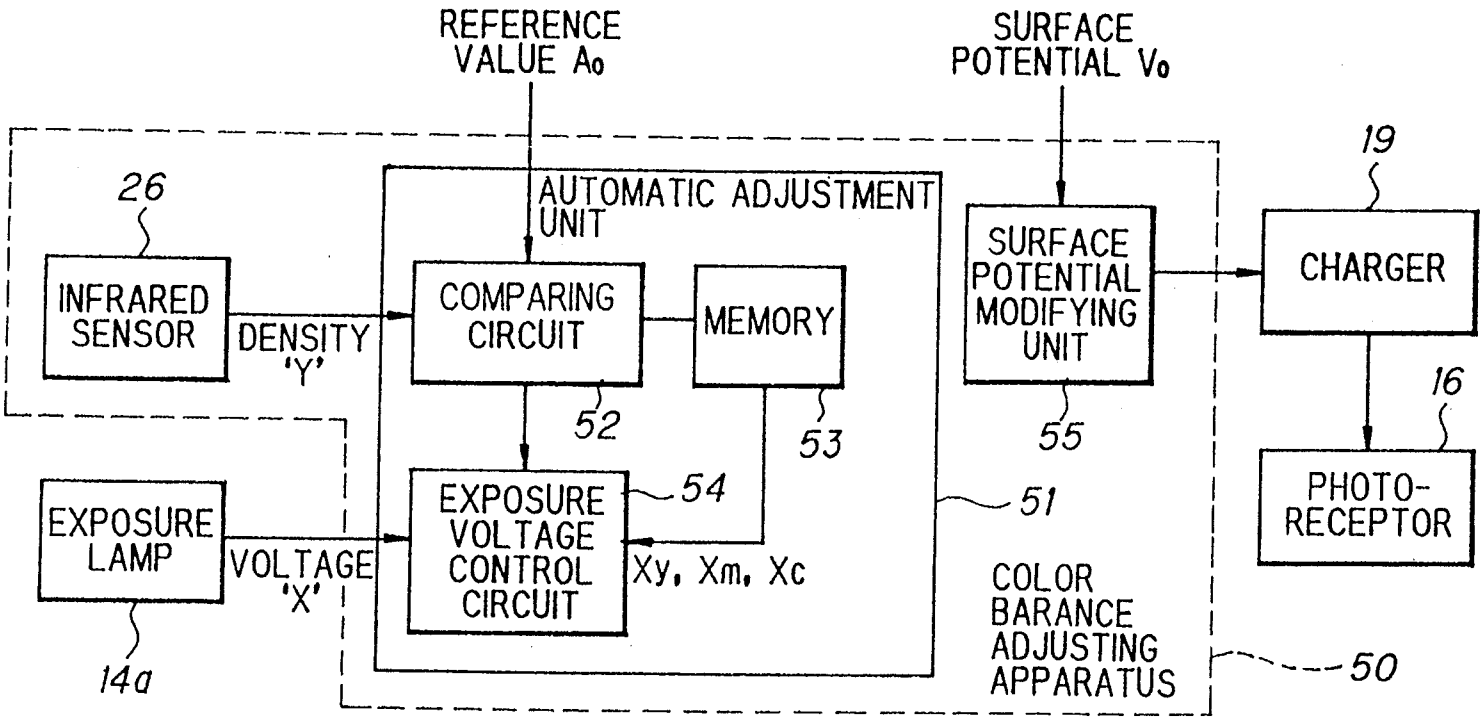
FIG. 1 is a block diagram showing one embodiment of a color balance adjusting apparatus according to the present invention.
Figure 4:
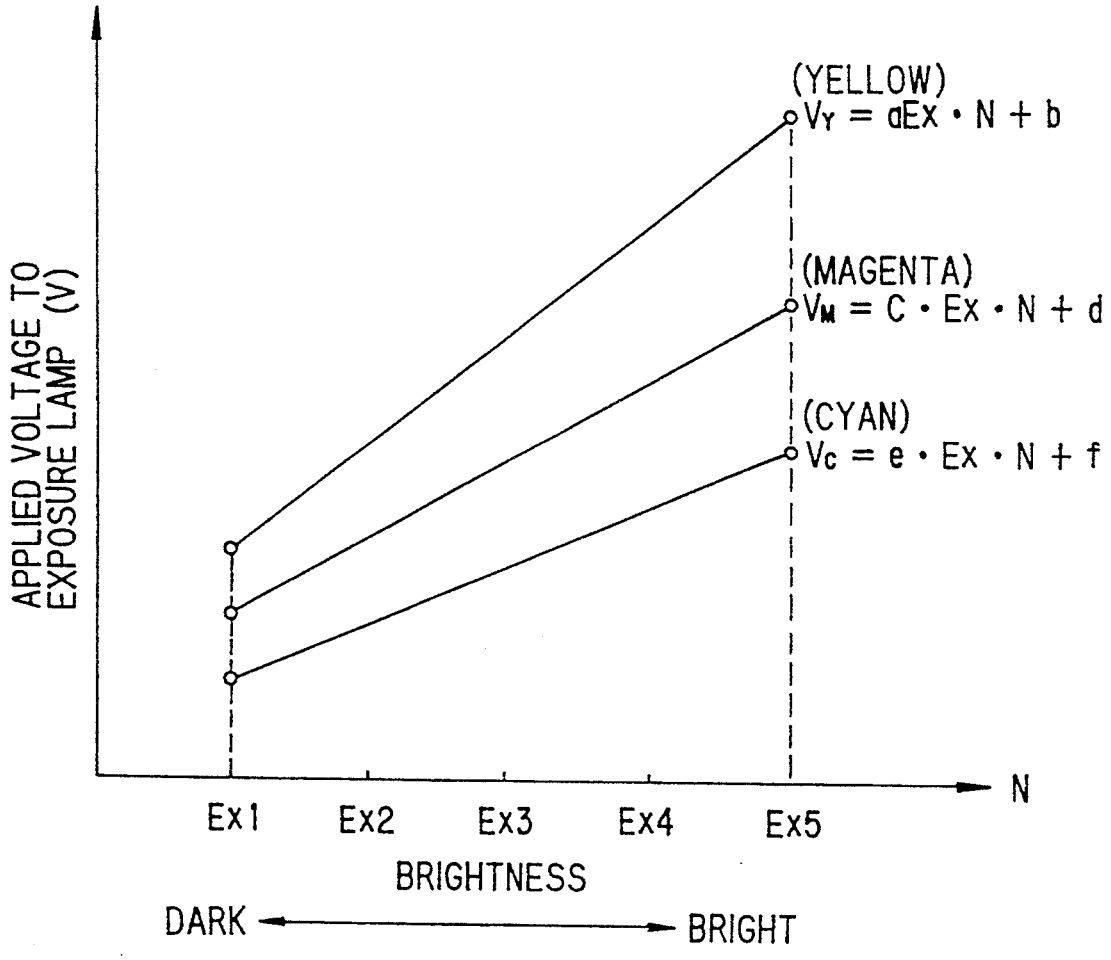
FIG. 4 is a graphic chart for illustrating an operation of a color balance adjusting apparatus shown in FIG. 1.

Referring now to FIGS. 1 and 4, detailed operation of color balance adjusting apparatus 50 thus configurated will be described by showing a case as an example where the components of magenta and cyan are calculated for the adjustment based on a value that has been adjusted for the yellow component.

First, surface potential modifying unit 55 controls the applied voltage to charger 19 so as to modify the surface potential of photoreceptor 16 into $V_0$. Subsequently, exposure voltage control circuit 54 applies to the exposure lamps 14a with a voltage of, for example, 50V, and thereafter, increases the applied voltage nine times by 3V step. Then, the thus exposed photoreceptor is developed, and each toner density of the developed image will be measured by infrared sensor 26. In this case, a blue filter is selected from color separating filters 14c, and yellow developer 20Y is activated.

Accordingly, the plain white image presented by at least one of the under surfaces of metal plate 12 and original pressing plate 13 is illuminated by exposure lamps 14a with ten-graded intensity of light, and the reflected light is introduced through the blue filter to position A of photoreceptor 16. Thus, electrostatic latent image is formed on photoreceptor 16. This electrostatic latent image is visualized by means of yellow developer 20Y, and the thus developed toner image is transferred onto intermediate transfer medium 21. Finally, each toner density Sn (n=1 to 10) is measured by infrared sensor 26.

Colorbalance adjusting apparatus 50 stores the toner density Sn and the associated applied voltage Ln to exposure lamps 14a in the memory. Likewise, color balance adjusting apparatus 50 picks up each toner density Sn that has been measured ten times in total by increasing the applied voltage to exposure lamps 14a by 3V from 50V, and stores in the memory each density Sn in association with the corresponding applied voltage Ln.

As a next step, the above ten measurements of toner density Sn and the associated applied voltage Ln are used to determine a relation between an yellow lamp voltage $V_y$ and a toner density $L_y$ by the least square approximation (Sn=a/Ln+b (a, b: constant)). Here, lamp voltages for yellow, magenta and cyan, or $V_Y$, $V_M$ and $V_C$ are expressed as Eq. 1, Eq. 2 and Eq. 3, respectively, as shown in FIG. 4 (where 'a' to 'f' are constants, N=1 to 5). Accordingly, if constants 'a' to 'f' are determined, it is possible to decide the lamp voltages $V_Y$, $V_M$ and $V_C$ and the toner densities $L_Y$, $L_M$ and $L_C$ for yellow, magnet and cyan.

$$V_Y = a \cdot Ex \cdot N + b \quad \text{(Eq. 1)}$$

$$V_M = c \cdot Ex \cdot N + d \quad \text{(Eq. 2)}$$

$$V_C = e \cdot Ex \cdot N + f \quad \text{(Eq. 3)}$$

Here, the constants 'a' to 'f' vary for individual copiers in dependence upon the surface potential of photoreceptor 16 and the dispersion of exposure optical system 14, it is impossible to determine their absolute values, but there holds certain relations between the slopes 'a', 'c', 'e' and the intercepts 'b', 'd', 'f', as shown in Eq. 4 and Eq. 5, regardless of individual copiers.

$$a:c:e = A:C:E \quad \text{(Eq. 4)}$$

$$b:d:f = B:D:F \quad \text{(Eq. 5)}$$

Therefore, if the constants A to F are experimentally determined beforehand, it is possible to decide the constants for magenta and cyan from Eq. 6 to Eq. 9 since the slope 'a' and intercept 'b' for yellow can be determined in the color balance adjustment mode.

$$c = a \cdot C/A \quad \text{(Eq. 6)}$$

$$E = a \cdot E/A \quad \text{(Eq. 7)}$$

$$d = b \cdot D/B \quad \text{(Eq. 8)}$$

$$f=b\cdot F/B \quad \text{(Eq. 9)}$$

The thus obtained lamp voltages $V_Y$, $V_M$ and $V_C$ and toner densities $L_Y$, $L_M$ and $L_C$ for yellow, magenta and cyan are used to calculate the optimal voltage values $x_y$, $x_m$ and $x_c$ for respective lamps and the calculated values are stored in memory 53. In a normal three-color duplication process, exposure voltage control circuit 54 controls the exposure voltage 'x' to be applied to exposure lamps 14*a* in accordance with these optimal values $x_y$, $x_m$ and $x_c$.

As described, according to the above embodiment, it is possible to decide the constants for magenta and cyan from the equations by determining the slope 'a' and intercept 'b' for yellow. Therefore, no image forming process is needed which would have been required as in the prior art to determine the constants for respective colors of yellow, magenta and cyan. As a result, it is possible to adjust the color balance automatically in a short time with lesser consumption of electricity and supplies.

Color copiers to which the present invention is applied include two kinds of copying process. One is the normal copying operation called a graphic process mode explained in the above embodiment. The other is a photoprocess mode in which the reproducibility of halftoned images is improved by using a screen 36 shown in FIG. 2.

Either process includes two copy forms: the full color copy where the reproduction is effected using color separate filters; and monochromatic copy where reproduction of images is effected with a single color. There is another mode called six-pass process where the above two modes, or the graphic process mode and photoprocess mode are combined to reproduce a halftoned image together with high density region.

The full color copy, the monochromatic copy, and the high density copy in the six-pass process, all included in the graphic process mode, have particular relations held between one and another. Therefore, if the color balance adjustment for any one mode that shares the same graphic process with others is effected, the conditions for the other modes can be determined by calculation.

In the full color copy mode, the reproduction is effected for yellow, magenta and cyan by using color separating filters. In contrast to this, the monochromatic copy mode conducts a reproduction of an original by a single color without performing color separation, therefore this mode uses the same lamp voltage for any of yellow, magnet and cyan. For this reason, it is possible to determine entire conditions for all the monochromatic modes by adjusting the color balance for any one of the colors.

To determine a condition for the monochromatic mode on the basis of the full color mode, a relation shown Eq. 10 can be obtained by experiment:

$$Vmo=K\cdot V_M+a_1 \quad \text{(Eq. 10)}$$

where Vmo is a lamp voltage for the mono-chromatic mode; $V_M$ is a lamp voltage for magenta in the full color mode; K is a coefficient; and $a_1$ is a constant that varies with the individual machine in dependence upon the increment of the surface potential of photoreceptor 16 and the dirtiness of the optical system. There are also relations existing as shown by the following equations Eq. 11 to Eq. 13 between the conditions for yellow, magenta and cyan in the full color copy mode, and the conditions for the high density reproduction copy in the six-pass process. Therefore it is possible to determine the lamp voltages for the six-pass process from the lamp voltages for the full color mode.

$$V_{Y\text{-}H}=K_1V_Y+G \quad \text{(Eq. 11)}$$

$$V_{M\text{-}H}=K_2V_M+H \quad \text{(Eq. 12)}$$

$$V_{C\text{-}H}=K_3V_C+I \quad \text{(Eq. 13)}$$

Here, $V_{Y\text{-}H}$, $V_{M\text{-}H}$ and $V_{C\text{-}H}$ are respectively lamp voltages in the high density region of six-pass HD process; $V_Y$, $V_M$ and $V_C$ are lamp voltages for yellow, magenta and cyan in the normal full color mode, respectively; $K_1$, $K_2$ and: $K_3$ are respective coefficients determined; G, H and I are constants that vary dependent upon the increment of the surface potential of photoreceptor 16 and the dirtiness of the optical system. Thus, it is possible to determine conditions for one copy mode by using previously known functions as long as lamp voltages for the other copy mode are known and the two belong to the same process mode.

Although the above description is exemplified for the graphic process mode, it is possible to determine conditions for one copy mode in a similar manner as long as lamp voltages for the other copy mode are known and the two copy modes belong to the same photo-process mode using a screen.

As has been described in detail, according to the present invention, the infrared sensor detects toner density of a toner image formed with a toner having any one color of first, second and third colors. Then, the automatic adjustment means determines a relation of the toner density to the light intensity for the color by changing the light intensity of the light source, and determines an optimal light intensity for the one color from the obtained relation. As a result, optimal light intensity for the other two colors are determined as predetermined functions of the color and can be obtained markedly easily by mere calculations.

Further, if the two copy modes belong to the same copy process mode, that is, the graphic process mode or the photo-process mode, the condition of one mode can be calculated similarly from the condition of the other mode by using predetermined functions. As a result, it is possible to perform an automatic adjustment of the color balance in a short time with lesser consumption of electricity and supplies, even in the case where an image density should be corrected at an initial life.

What is claimed is:

1. A color balance adjusting apparatus for use in a full color copier in which an original image is illuminated by a light source; the illuminated image is exposed onto a photoreceptor to form electrostatic latent images corresponding to first, second and third colors for creating a color image; and each of the formed electrostatic latent images is developed into a visualized toner image, said color balance-adjusting apparatus comprising:

an infrared sensor for detecting toner density of said toner image formed with a toner having any one color of said first, second and third colors; and automatic adjustment means, determining a relation of light intensity to toner density detected for one color by varying light intensity of said light source, and determining optimal light intensity for the other two colors as predetermined functions of obtained optimal light intensity.

2. A color balance adjusting apparatus for use in a full color copier in which an original image is illuminated by a light source; the illuminated image is exposed onto a photoreceptor to form electrostatic latent images corresponding to first, second and third colors for creating a color image; and each of the formed electrostatic latent images is developed into a visualized toner image, said color balance adjusting apparatus comprising:

an infrared sensor for detecting toner density of said toner image formed with a toner having any one color of said first, second and third colors; and automatic adjustment means, determining a relation of light intensity to toner density detected for one color by varying light intensity of said light source, and determining optimal light intensity for the other two colors as predetermined functions of obtained optimal light intensity, being characterized in that said automatic adjustment means operates in link with an image density automatically controlling function and effects said automatic adjustment after an image density correction.

3. A color balance adjusting apparatus for use in a full color copier in which an original image is illuminated by a light source; the illuminated image is exposed onto a photoreceptor to form electrostatic latent images corresponding to first, second and third colors for creating a color image; and each of the formed electrostatic latent images is developed into a visualized toner image, said color balance adjustment apparatus comprising:

an infrared sensor for detecting toner density of said toner image formed with a toner having any one color of said first, second and third colors; and automatic adjusting means, determining a relation of light intensity to toner density detected for one color by varying light intensity of said light source, and determining optimal light intensity for the other two colors as predetermined functions of obtained optimal light intensity, being characterized in that said means uses the obtained optimal light intensity for three-colors and determines optimal light intensity for each of other copy modes belonging to the same copy process by using predetermined functions.

4. A color balance adjusting apparatus for use in a full color copier in which an original image is illuminated by a light source; the illuminated image is exposed onto a photoreceptor to form electrostatic latent images corresponding to first, second and third colors for creating a color image; and each of the formed electrostatic latent images is developed into a visualized toner image, said color balance adjusting apparatus comprising:

an infrared sensor for detecting toner density of said toner image formed with a toner having any one color of said first, second and third colors; and automatic adjustment means, determining a relation of light intensity to toner density detected for one color by varying light intensity of said light source, and determining optimal light intensity for the other two colors as predetermined functions of obtained optimal light intensity, being characterized in that said means uses the obtained optimal light intensity for three-colors and determines optimal light intensity for each of other copy modes belonging to the same copy process by using predetermined functions; and said automatic adjustment means operates in link with an image density automatically controlling function and effects said automatic adjustment after an image density correction.

* * * * *